US006386185B1

(12) United States Patent
Cooke

(10) Patent No.: US 6,386,185 B1
(45) Date of Patent: May 14, 2002

(54) VALVE ARRANGEMENT

(75) Inventor: Michael Peter Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/663,505

(22) Filed: Sep. 15, 2000

(30) Foreign Application Priority Data

Sep. 28, 1999 (GB) ..... 9922808

(51) Int. Cl.[7] ..... F02M 37/04
(52) U.S. Cl. ..... 123/506; 123/446; 123/458
(58) Field of Search ..... 123/509, 458, 123/446, 467, 506

(56) References Cited

U.S. PATENT DOCUMENTS 4,790,277 A * 12/1988 Schechter ..... 123/357
5,373,828 A * 12/1994 Askew et al. ..... 123/506
5,390,692 A * 2/1995 Jones et al. ..... 123/467
5,462,252 A * 10/1995 Thomas ..... 123/457
5,517,973 A * 5/1996 Askew et al. ..... 123/506
5,567,134 A * 10/1996 Inoue ..... 417/490
5,624,072 A * 4/1997 Okajima et al. ..... 239/92
RE36,768 E * 7/2000 Lear et al. ..... 123/531

* cited by examiner

*Primary Examiner*—Thomas N. Moulis
(74) *Attorney, Agent, or Firm*—Thomas A. Twomey

(57) ABSTRACT

A valve arrangement for a fuel injector arrangement, in which liquid fuel is drawn from a low pressure drain source and supplied from a pump at high pressure through a main fuel supply passage to an outlet of the injector arrangement. The valve arrangement includes a pressure regulating means which, during the course of an injection, regulates the pressure of fuel being supplied to the outlet. The pressure in the main fuel supply passage is regulated to a preselected pressure, which is intermediate drain pressure and pump supply pressure.

19 Claims, 3 Drawing Sheets

VALVE ARRANGEMENT

TECHNICAL FIELD

This invention relates to a valve arrangement for use in an injector arrangement.

BACKGROUND OF THE INVENTION

Fuel injectors are known which are adapted to draw liquid fuel from a low pressure drain source and supply the fuel at high pressure to an outlet of the injector. Such injectors commonly have actuating means which controls a spill valve or other type of valve for controlling delivery of fuel from the injector. In this type of injector, a spill valve in axial alignment with a main fuel supply passage for supplying fuel to the injector nozzle is commonly used. Generally, the valve is either fully open, to tend to reduce the pressure in the main fuel supply passage to that of the low pressure drain, or fully closed, so as to maintain high pressure in the main fuel supply passage for injecting fuel from an injector outlet.

SUMMARY OF THE INVENTION

One problem with the above-described type of injector is that excessive pressure can be generated in the fuel-carrying passages in the injector, leading to possible structural failure of the fuel system and, in certain circumstances, the engine served by the fuel system. Another problem with the type of injector described above is that there is generally no provision for maintaining an intermediate pressure between drain pressure and pumping pressure. A particular difficulty is that, in the conventional valve arrangement, a large proportion of the actuator stroke would be taken up in moving the valve from its fully open position to the region in which it can precisely control flow to obtain a preselected intermediate pressure. For example, approximately 90% of the actuator stroke would be used to reduce the spill area sufficiently to maintain pressure at one quarter of normal supply pressure. It is difficult to control accurately the last 10% of valve travel. To maintain accuracy at the high speed required, a very large actuator would be necessary.

The invention provides a valve arrangement for an injector arrangement adapted to draw liquid fuel from a low pressure drain source and supply the fuel from a pump at high pressure through a main fuel supply passage to an outlet of the injector arrangement, the valve arrangement including pressure regulating means operable during the course of an injection to regulate the pressure of fuel being supplied to the outlet so as to provide a preselected pressure in the main fuel supply passage which is intermediate drain pressure and pump supply pressure.

Conveniently, the pressure regulating means comprises a spill valve. Using the spill valve for pressure regulating purposes obviates the requirement for separate pressure regulating means, facilitating the provision of a smaller and less complex injector arrangement.

Preferably, the pressure regulating means is operable to automatically prevent further increase of fuel pressure in the main supply passage when the pressure in that passage reaches a predetermined level.

The pressure regulating means may comprise a valve member and actuating means operable to move the valve member along an axis. The actuating means conveniently comprises a piezo electric actuator. The pressure regulating means may include auxiliary control means for co-operating with the actuating means to control the position of the valve member along the axis.

The auxiliary control means preferably uses fuel at pump supply pressure to oppose the force of the actuating means. This facilitates the provision of efficient over-pressure protection. A more linear operating characteristic is also facilitated in that valve member position is controlled using a significant portion of the stroke of the actuating means.

The axis along which the valve member is movable preferably extends laterally across the main fuel supply passage.

The valve arrangement may include a housing portion having a bore containing the valve member communicating with a larger bore containing a piston driven by an actuator, respective surfaces of the larger bore, the valve member and the piston together forming a control chamber adapted to receive fuel.

Relief means is conveniently provided, operable to direct leakage flow from the main supply passage away from the control chamber.

The valve arrangement may include cooling means operable to cool the actuator. Preferably, the cooling means circulates fuel through a chamber in which the actuator is disposed. The arrangement may be such that spill and filling pulses are utilised during operation of the injector to circulate fuel through the chamber. The invention also provides actuating means comprising an actuator for actuating a valve member in a fuel injector, the actuating means being provided with cooling means for cooling the actuator.

The invention also includes a valve arrangement for an injector arrangement adapted to draw liquid fuel from a low pressure drain source and supply the fuel from a pump at high pressure through a main fuel supply passage to an outlet of the injector arrangement, the valve arrangement including pressure regulating means operable to automatically prevent further increase of fuel pressure in the main supply passage when the pressure in that passage reaches a predetermined level.

The valve arrangement may form part of a unit pump which supplies fuel to a fuel injector through a high pressure supply passage, or may form part of the fuel injector or may form part of a unit injector in which the pump and the injector are combined in a single unit.

BRIEF DESCRIPTION OF THE DRAWINGS

In order that the invention may be better understood, two embodiments thereof will now be described with reference to the accompanying drawings, in which.

DESCRIPTION OF THE PREFERRED EMBODIMENT

Figure 1:
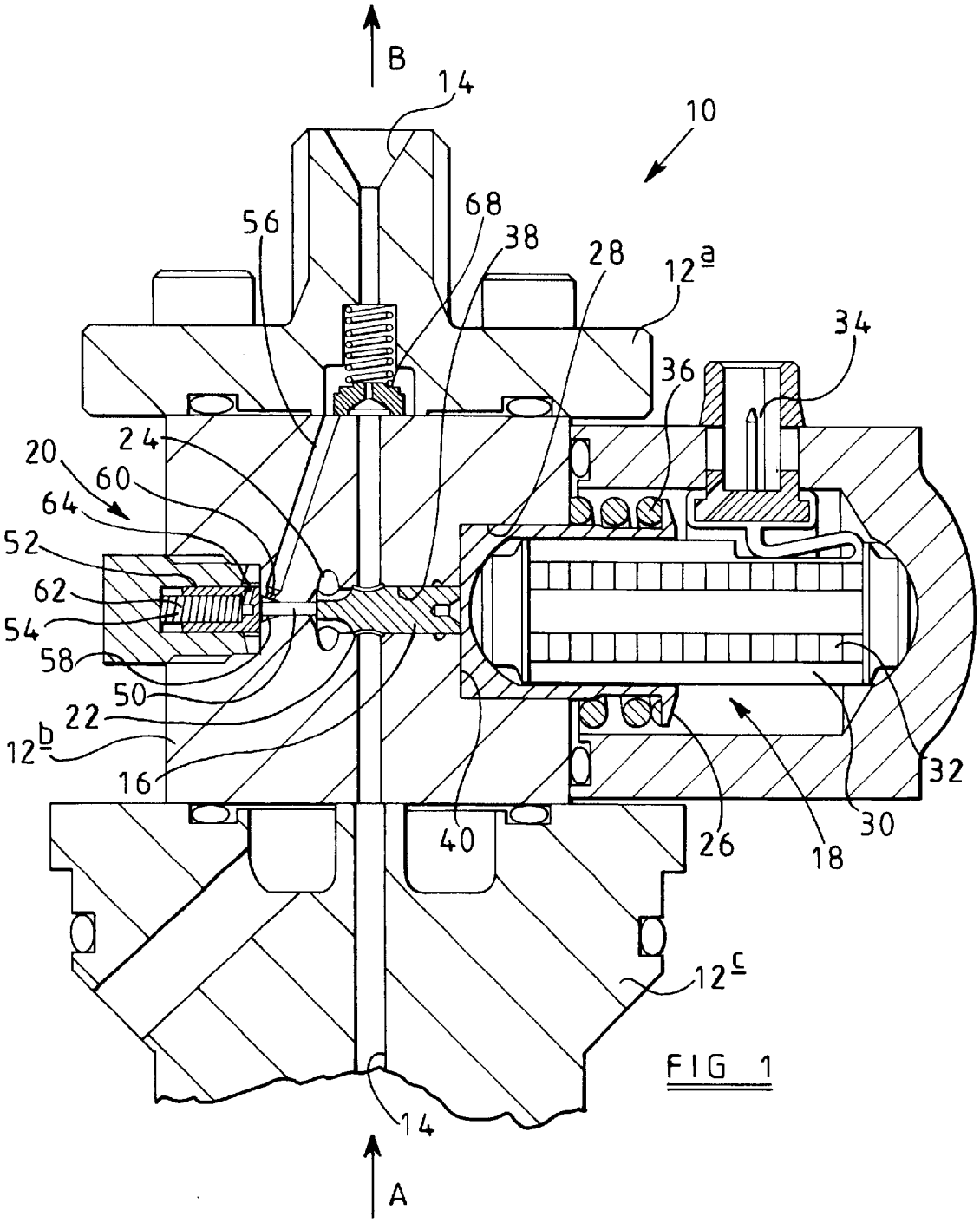
FIG. 1 is a partial cross-section through a portion of a fuel injector showing a spill valve arrangement including high pressure supply passages.
Figure 2:
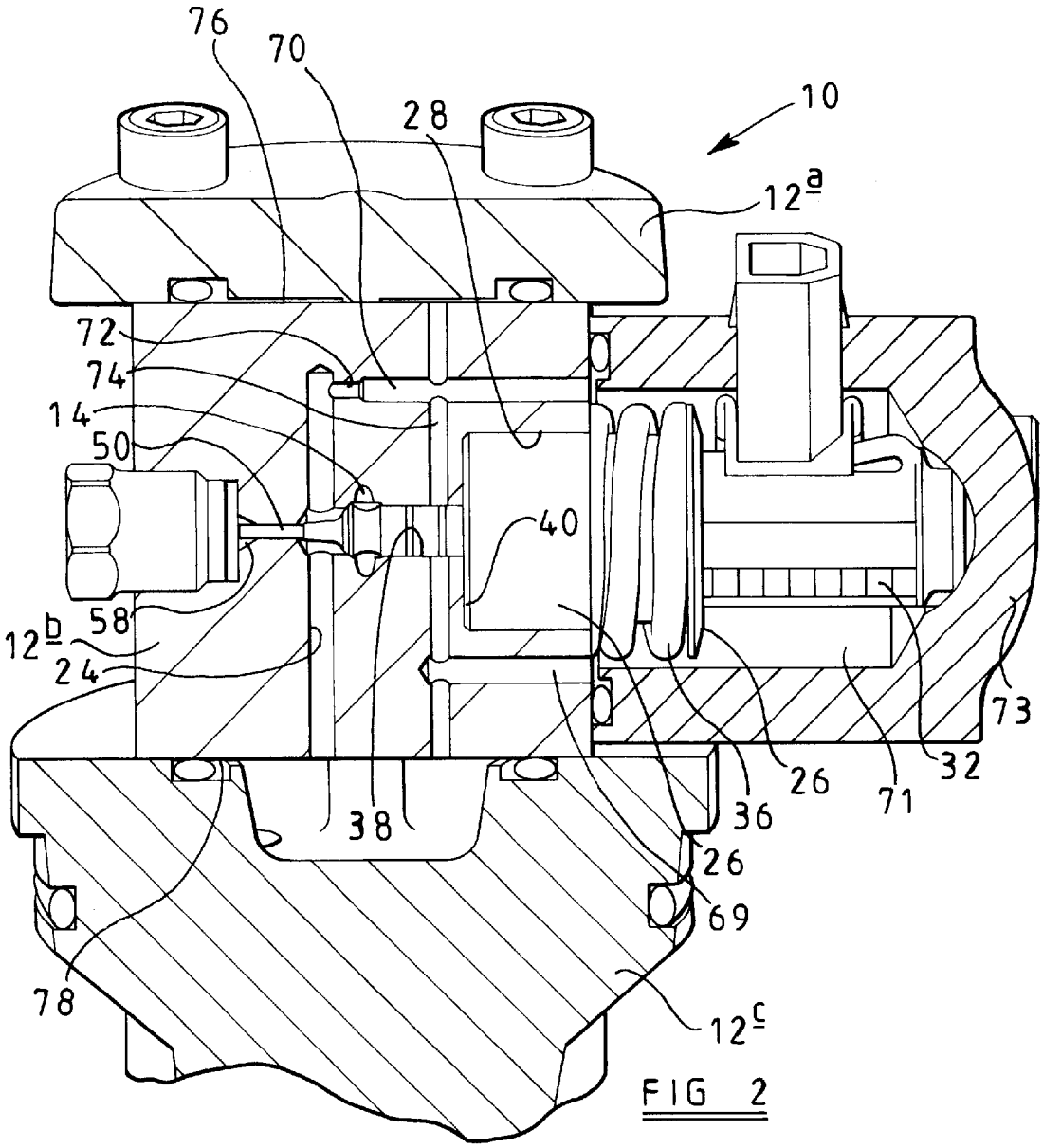
FIG. 2 is a partial cross-section through the injector of FIG. 1 showing the arrangement of low pressure fuel passages.

Referring now to FIGS. 1 and 2, an injector arrangement shown generally as 10 comprises three housing portions 12*a*, 12*b*, 12*c*, housing portion 12*c* forming part of a unit pump. A main fuel supply passage 14 passes through each of the housing portions 12*a,* 12*b,* 12*c* and carries fuel from the pump in the direction of arrow A towards an outlet of the injector (not shown) in the direction of arrow B during the high pressure stroke of the pump. The direction of flow along the passage 14 is reversed during the low pressure, or suction, stroke of the pump. Pressure regulating means is provided in the form of a spill valve member 16 the position of which is controlled by actuating means shown generally as 18 in combination with auxiliary control means shown generally as 20. The spill valve member 16 is movable transversely of the main supply passage 14 so as to control flow through a spill orifice 22 and thereby control pressure in the passage 14. The valve member 16 either seats against the sides of the orifice so as to completely prevent flow therethrough, completely unseats from the orifice so as to provide maximum flow therethrough, or maintains a preselected distance from the orifice so as to allow a predetermined rate of flow therethrough. A low pressure passageway 24 is disposed on the opposite side of the orifice from the main fuel supply passage 14 and communicates with a low pressure drain source.

Primary control of the axial position of the spill valve member 16 is provided by the actuating means 18. The actuating means 18 comprises a control piston 26 driveable along a bore 28 in the housing 12*b* by an actuator 30 comprising a piezo electric stack 32 capped at each end. The actuator 30 is connectable to a power source by a connector 34. The piston 26 is resiliently biased by a spring 36 in a direction tending to compress the stack 32. The bore 28 communicates with a smaller bore 38 which contains and guides the spill valve member 16.

Respective surfaces of these intercommunicating bores 28,38, the spill valve member 16, and the piston 26 define a control chamber 40 which contains fuel. When electrical power is supplied to the piezo electric stack 32 so as to expand the stack, the piston 26 is driven towards the end of the large bore 28 so as to reduce the volume of the large cross-sectional area portion of the chamber 40 defined by bore 28 and drive fluid into the small cross-sectional area portion of the chamber defined by bore 38, thereby moving the spill valve member 16 towards its seated position (towards the left as shown in FIGS. 1 and 2).

To move the spill valve member 16 in a direction away from seating with the orifice 22, the piezo electric stack 32 is compressed by application of appropriate electrical signals, so as to allow the biasing spring 36 to return the piston 26 towards the right as shown in FIGS. 1 and 2. Additionally, the auxiliary control means 20 acts so as to drive the spill valve member 16 towards the right as shown in FIGS. 1 and 2.

The auxiliary control means 20 comprises a piston 50 biased by means of a damper piston 52 containing an auxiliary biasing spring 54 in a direction so as to unseat the spill valve member 16 from the orifice 22 (towards the right in FIGS. 1 and 2). Thus, with the piezo electric stack contracted and low pressure in the fuel supply passage 14, the auxiliary control means is able to drive the spill valve member 16 by means of the biasing spring 54 so as to open the orifice 22. The auxiliary control means 20 further comprises a control passage 56 which connects the main fuel supply passage 14 with an auxiliary control chamber 58 situated about an end of the piston 50. During the high pressure stroke of the pump, high pressure is transmitted from fuel in the main fuel supply passage 14 along the passage 56 into the auxiliary control chamber 58. The high pressure in auxiliary control chamber 58 acts to drive the piston 50 and thus the spill valve member 16 in a direction so as to unseat the spill valve member 16 from the orifice 22 (towards the right in FIGS. 1 and 2). An orifice 60 of reduced cross-sectional area may be provided along the auxiliary control passage 56 in order to delay the unseating effect on the spill valve member 16 for a predetermined time following the occurrence of high pressure in the passage 14.

In operation, when it is desired to commence an injection, the actuator 30 is operated so as to drive the spill valve member 16 towards its closed position. The fuel displaced in the control chamber 40 closes the spill valve 16,22. The rate of closure is suitably controlled by the damper piston 52 according to the rate at which fluid can exit a damper chamber 62 through a damper orifice 64. Further operation of the actuator 30 so as to apply a force tending to expand the actuator 30 applies the spill valve member 16 to the seat of the orifice 22 with greater force. However, the piston 50 applies an increasing force tending to unseat the spill valve member 16, due to the increase in pressure in passage 14 being transmitted along passage 56. The rate of increase of the unseating force is dependent on the size of the orifice 60. For a given actuator force, a point will be reached when the spill valve member 16 lifts from its seat, and limits further pressure increase in the passage 14, as fuel is able to flow to the low pressure drain. Full injection pressure is obtained by signalling the piezo electric stack 32 to fully extend and therefore apply its maximum force. Automatic overprotection is provided by this arrangement since once the pressure in passage 14 is sufficient to drive the piston 50 with greater force than the maximum force provided by the piezo electric stack 32, the spill valve member 16 automatically opens. A preselected intermediate pressure can be obtained in the main fuel supply passage 14 by selecting the level of force supplied by the actuator 30.

A particular advantage of the arrangement described above is that a relatively small proportion of the actuator stroke, for example 40%, can be sufficient to close the spill valve 16,22, whilst the remaining travel, perhaps 60% of the actuator stroke, remains available to control the spill valve opening pressure with a reasonably linear characteristic. In this manner, quick, accurate and safe control of pressure in the main fuel supply passage is provided. It is possible to use a much less powerful, and smaller, actuator than if a conventional actuator were used to control a conventional spill valve. In the latter case, it would be very difficult to control the actuator in its operating region, which would be the final 10% of its stroke, thus necessitating a larger and stiffer actuator. By using a smaller actuator, there is also an inherent lack of stiffness which can be advantageous as a larger proportion of the stroke is required to generate the force to oppose the pressure. In this way, the accuracy of pressure control can be improved.

At the end of the injection, the actuator is contracted to its normal length, opening the spill valve and causing depressurisation of the main fuel supply passage 14 through the drain passage 24. Pressure decay in the main fuel supply passage 14 can be controlled by controlling contraction of the actuator in an appropriate manner. For example, a residual pressure may be applied to fuel in the main fuel supply passage 14 for sufficient time to prevent combustion gases from being blown past the seat of the injector nozzle. Because the auxiliary control passage 56 is supplied from a portion of passage 14 above the usual delivery valve 68, the force applied by piston 50 will be maintained for a certain amount of time after the pressure in the region of the fuel supply passage 14 adjacent the orifice 22 has dropped, thereby ensuring that the spill valve member 16 is moved to its fully open position.

Fuel in the control chamber 40 can be recirculated and replaced by contracting the stack 32 below its natural length to draw fuel into the control chamber. In this case, the stack should be returned to its normal length before the next injection so that excess fuel can be expelled by leakage back out of the chamber allowing the valve 16 to regain its starting position. Alternatively, it may be considered sufficient to rely on natural leakage characteristics to replace the fuel in chamber 40 with fresh fuel.

As best seen in FIG. 2, a cooling circulation passage 70 is provided communicating at one end with the low pressure drain passage 24 and at its other end with a cooling chamber 71 defined by an actuator housing 73 in which the actuator 30 is contained. A restricted orifice 72 is provided in the cooling circulation passage 70. During the relatively long filling phase of an injection cycle, the spill valve is open and fuel is driven into the chamber 71, primarily through the lower drilling 69, and exits through the passage 70. A relatively high volume of fuel flows through the orifice 72 at relatively low pressure for a relatively long period. On the other hand, during the spill phase of the injection cycle, flow is reversed along the passage 70. However, spill flow is at relatively high pressure for a relatively short period of time, and the orifice 72 restricts the high pressure flow therethrough to a greater extent than it restricts the low pressure flow. A net "anticlockwise" circulation flow from the chamber 71 and along the passage 70 is thereby provided. This effect is enhanced by making the side of the orifice 72 presented to the spill flow sharp edged, as shown, whilst the side of the orifice presented to the chamber 71 is rounded or conical.

Leakage around the spill valve member 16 can be very significant at high pressure. For example, such leakage can be of comparable magnitude to the fluid displaced by the control piston. A passage 74 is provided to divert such leakage volume into the cooling circulation circuit or direct to the low pressure drain. Passage 74 also serves to collect and redirect any high pressure leakage volume from the valve housing interfaces 76,78.

Figure 3:
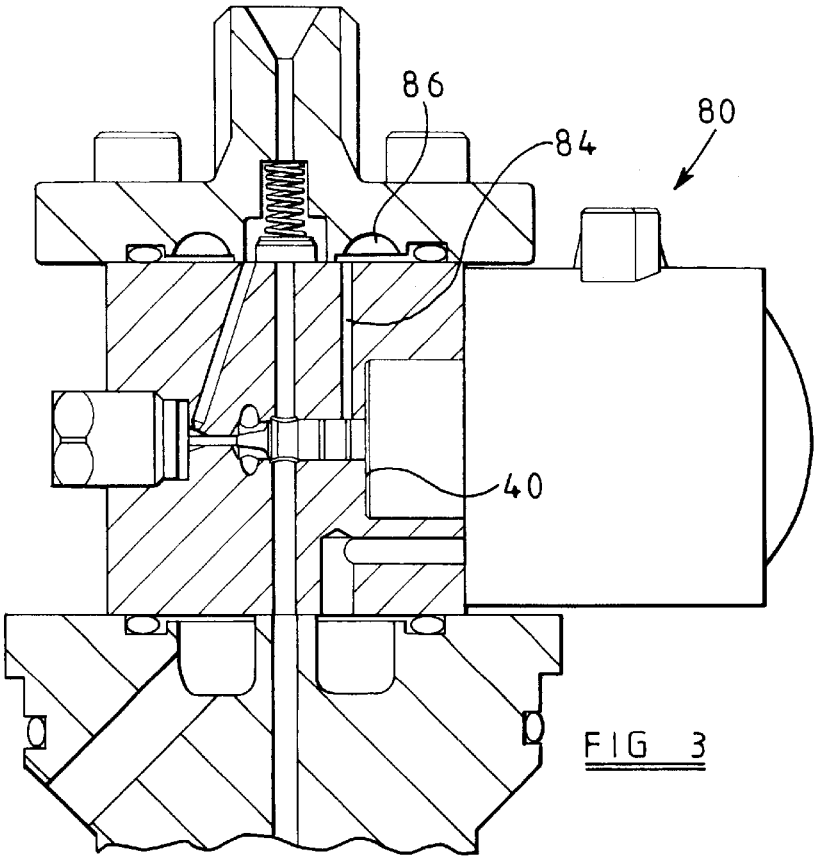
FIG. 3 shows a partial cross-section through a portion of another fuel injector having a different high pressure fuel supply passage arrangement.
Figure 4:
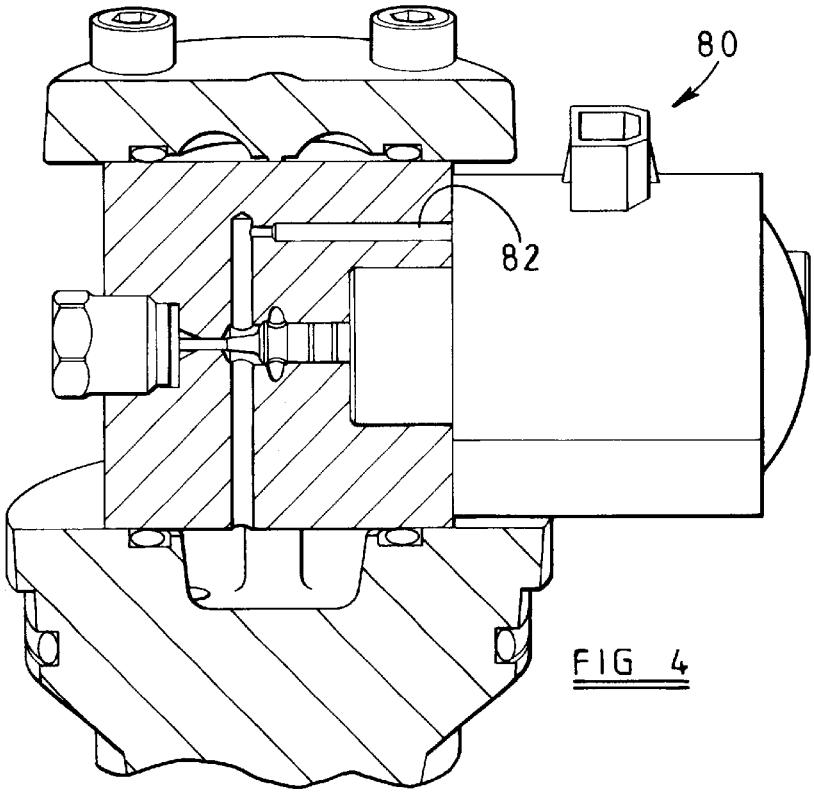
FIG. 4 is a partial cross-section through the fuel injector of FIG. 3 showing the arrangement of low pressure fuel passages.

FIGS. 3 and 4 show a portion of an alternative fuel injector shown generally as 80. The fuel injector 80 is identical with the fuel injector 10 except for the details discussed below, and redundant description relating to identical features is dispensed with. Fuel injector 80 has a cooling circulation passage 82 having a similar function to the passage 70 in fuel injector 10. However, the passage 82 does not communicate with a passage similar to passage 74 in the first embodiment for diverting leakage from the spill valve member 16 away from the control chamber 40. Rather, a passage 84 (FIG. 3) is provided which diverts leakage flow from around the spill valve member 16 to an accumulator chamber 86. High pressure leakage flow can be stored in the chamber 86 at an intermediate pressure and used to slowly top-up the control chamber 40 between injections. This has the advantage of reducing the chances of the control chamber 40 failing to refill following a long high pressure injection.

It should be apparent that the above-described injectors provide a convenient and efficient means of preventing excessive pressure build up and subsequent damage to the fuel supply system. The injectors 10,80 are also particularly effective in providing a preselected intermediate pressure during injection using a relatively small actuator. In particular, valve control is enhanced by using a large proportion, for example 60%, of the stroke of the actuator for controlling injection pressure. This enhances the accuracy obtainable with a relatively small actuator.

In the accompanying drawings, the valve arrangement forms part of a unit pump which supplies fuel to the nozzle of a fuel injector through a high pressure fuel line. It will be appreciated, however, that the valve arrangement may be arranged to form part of the fuel injector or may form part of a unit injector arrangement in which the injector and the pump are combined in a single unit.

What is claimed is:

1. A valve arrangement for an injector arrangement adapted to draw liquid fuel from a low pressure drain source and supply the fuel from a pump at high pressure through a main fuel supply passage to an outlet of the injector arrangement, the valve arrangement including a pressure regulating valve, operable during the course of an injection to regulate the pressure of fuel being supplied to the outlet so as to provide a preselected pressure in the main fuel supply passage which is intermediate drain pressure and pump supply pressure.

2. A valve arrangement according to claim 1, wherein the pressure regulating valve comprises a spill valve.

3. A valve arrangement according to claim 1, wherein the pressure regulating valve is operable to automatically prevent further increase of fuel pressure in the main fuel supply passage when the pressure in the main fuel supply passage reaches a predetermined level.

4. A valve arrangement according to claim 1, wherein the pressure regulating valve comprises a valve member and actuating arrangement operable to move the valve member along an axis.

5. A valve arrangement according to claim 4, wherein the pressure regulating valve comprises a spill valve.

6. A valve arrangement according to claim 4, wherein the actuating arrangement comprises a piezo electric actuator.

7. A valve arrangement according to claim 4 wherein the pressure regulating valve includes an auxiliary control device for co-operating with the actuating arrangement to control the position of the valve member along the axis.

8. A valve arrangement according to claim 7, wherein the auxiliary control device is arranged to use fuel at pump supply pressure to oppose the force of the actuating arrangement.

9. A valve arrangement according to claim 4, wherein the axis along which the valve member is movable extends laterally across the main fuel supply passage.

10. A valve arrangement according to claim 4, including a housing portion having a first bore containing the valve member, the first bore communicating with a second bore having a greater diameter than the first bore, the second bore containing a piston driven by an actuator, respective surfaces of the second bore, the valve member and the piston together forming a control chamber for receiving fuel.

11. A valve arrangement according to claim 10, wherein the pressure regulating valve comprises a spill valve.

12. A valve arrangement according to claim 10, wherein a relief passage is provided, the relief passage being operable to direct leakage flow from the main fuel supply passage away from the control chamber.

13. A valve arrangement according to claim 10, wherein the axis along which the valve member is movable extends laterally across the main fuel supply passage.

14. A valve arrangement according to claim 4, wherein the actuating arrangement comprises an actuator, a cooling system being operable to circulate fuel through a further chamber in which the actuator is disposed.

15. The valve arrangement of claim 14 wherein the pump is operative to provide spill and filling pulses, whereby the spill and filling pulses are utilized during operation of the injector arrangement to circulate fuel through the chamber.

16. A valve arrangement for an injector arrangement adapted to draw liquid fuel from a low pressure drain source and supply the fuel from a pump at high pressure through a main fuel supply passage to an outlet of the injector arrangement, the valve arrangement including a pressure regulating valve operable to automatically prevent further increase of fuel pressure in the main supply passage when the pressure in the main supply passage reaches a predetermined level.

17. A valve arrangement according to claim 16, wherein the pressure regulating valve comprises a spill valve.

18. A valve arrangement according to claim 1, wherein the valve arrangement forms part of a unit, the unit comprising the valve arrangement and components selected from one of (a) the pump, (b) a fuel injector forming part of the injector arrangement, and (c) the pump and a fuel injector of the injector arrangement.

19. A valve arrangement according to claim 14, wherein the valve arrangement forms part of a unit, the unit comprising the valve arrangement and components selected from one of (a) the pump, (b) a fuel injector forming part of the injector arrangement, and (c) the pump and the fuel injector.

* * * * *